US011713523B2

(12) United States Patent
Suchomel et al.

(10) Patent No.: US 11,713,523 B2
(45) Date of Patent: Aug. 1, 2023

(54) FABRIC MADE OF INTERWOVEN TWINES

(71) Applicant: LENZING AKTIENGESELLSCHAFT, Lenzing (AT)

(72) Inventors: Friedrich Suchomel, Schorfling am Attersee (AT); Dieter Eichinger, Furstenfeld (AT)

(73) Assignee: LENZING AKTIENGESELLSCHAFT, Lenzing (AT)

( * ) Notice: Subject to any disclaimer, the term of this patent is extended or adjusted under 35 U.S.C. 154(b) by 308 days.

(21) Appl. No.: 17/275,239

(22) PCT Filed: Sep. 6, 2019

(86) PCT No.: PCT/EP2019/073786
§ 371 (c)(1),
(2) Date: Mar. 11, 2021

(87) PCT Pub. No.: WO2020/053080
PCT Pub. Date: Mar. 19, 2020

(65) Prior Publication Data

US 2022/0049384 A1 Feb. 17, 2022

(30) Foreign Application Priority Data

Sep. 13, 2018 (EP) ..... 18194179

(51) Int. Cl.

| | |
|---|---|
| ***D03D 15/47*** | (2021.01) |
| ***D03D 1/00*** | (2006.01) |
| ***D03D 15/283*** | (2021.01) |
| ***D03D 15/225*** | (2021.01) |
| ***D03D 15/41*** | (2021.01) |

(52) U.S. Cl.
CPC ..... *D03D 15/47* (2021.01); *D03D 1/0041* (2013.01); *D03D 15/225* (2021.01); *D03D 15/283* (2021.01); *D03D 15/41* (2021.01); *D10B 2201/24* (2013.01); *D10B 2331/04* (2013.01); *D10B 2505/12* (2013.01)

(58) Field of Classification Search
CPC .... D03D 15/47; D03D 1/0041; D03D 15/225; D03D 15/283; D03D 15/41; D03D 1/00; D03D 15/20; D03D 15/208; D03D 15/54; D10B 2201/24; D10B 2331/04; D10B 2505/12; D10B 2201/22
See application file for complete search history.

(56) References Cited

U.S. PATENT DOCUMENTS

| | | | | |
|---|---|---|---|---|
| 4,352,380 | A * | 10/1982 | Owen | D03D 15/283 28/163 |
| 6,136,432 | A * | 10/2000 | Burrow | D02G 3/04 428/362 |
| 6,318,166 | B1 * | 11/2001 | Roos | G01N 3/08 73/160 |
| 6,509,286 | B2 * | 1/2003 | Albin | D03D 15/50 139/420 R |
| 8,684,043 | B2 * | 4/2014 | Baumeler | D03D 13/004 139/420 R |
| 9,708,736 | B2 * | 7/2017 | Agarwal | D03D 13/008 |
| 10,316,438 | B2 * | 6/2019 | Lipscomb | D02G 3/04 |
| 10,428,445 | B2 * | 10/2019 | Agarwal | D03D 15/47 |
| 10,988,868 | B2 * | 4/2021 | Mittal | D02G 3/36 |
| 11,519,104 | B2 * | 12/2022 | Klaus-Nietrost | D01F 2/00 |
| 2001/0024918 | A1 | 9/2001 | Albin | |
| 2008/0132133 | A1 * | 6/2008 | Yasui | D03D 15/283 442/200 |
| 2009/0019624 | A1 * | 1/2009 | Birk | D02G 3/04 2/81 |
| 2010/0330351 | A1 * | 12/2010 | Crnoja-Cosic | D03D 15/283 442/310 |
| 2019/0315090 | A1 * | 10/2019 | Lee | B32B 5/022 |
| 2020/0240051 | A1 * | 7/2020 | Carls | D03D 15/225 |
| 2020/0291551 | A1 * | 9/2020 | Carls | D06L 4/24 |
| 2020/0308737 | A1 * | 10/2020 | Carls | D04B 1/24 |
| 2020/0347520 | A1 * | 11/2020 | Klaus-Nietrost | D01F 2/02 |

FOREIGN PATENT DOCUMENTS

| | | |
|---|---|---|
| CN | 207523508 U | 6/2018 |
| EP | 1127969 A1 | 8/2001 |
| EP | 2487283 A1 | 8/2012 |

OTHER PUBLICATIONS

European Textile Labelling Act (https://eur-lex.europa.eu/legal-content/EN/TXT/PDF/?uri=CELEX:32011R1007&qid=1647027221391&from=EN).

* cited by examiner

*Primary Examiner* — Robert H Muromoto, Jr.
(74) *Attorney, Agent, or Firm* — Venable LLP

(57) ABSTRACT

A fabric made of interwoven twines, wherein, in each case, two yarns are twisted together to form a twine and at least one of the yarns contains polyester staple fibers and cellulosic staple fibers of the types lyocell, viscose and/or modal, the share of cellulosic staple fibers in the fabric ranging from 10% by weight to 90% by weight. The fabric according to the invention is characterized in that the fabric or, respectively, those of the yarns contained therein which contain polyester staple fibers and cellulosic staple fibers as well as the twines produced therefrom comply with two relationships from which the suitability of the fabric for applications in automobiles, particularly in automobile seats, results.

33 Claims, No Drawings

FABRIC MADE OF INTERWOVEN TWINES

The present application is a national-stage entry under 35 U.S.C. § 371 of International Patent Application No. PCT/EP2019/073786, published as WO 2020/053080 A1, filed Sep. 6, 2019, which claims priority to EP 18194179.0, filed Sep. 13, 2018, the entire disclosure of each of which is hereby incorporated by reference.

BACKGROUND OF THE INVENTION

Field of the Invention

The present invention relates to a fabric made of interwoven twines, which is suitable for use in automotive applications, in particular as a fabric cover in automobile seats.

The invention relates to fabrics for use in automobile seats (in particular for surfaces which come into contact with the vehicle occupants) and to automobile seats which contain the fabrics according to the invention. Such fabrics are subject to strong mechanical stress during the usually many years of use, but may show as little wear and tear as possible. Wear and tear is caused in particular by abrasion and pilling.

At the same time, the requirements with regard to good seating comfort are increasingly rising. The seating comfort can be noticeably increased by using fibers with a good moisture absorption capacity. Especially cellulosic fibers and wool might be suitable for this, but usually they have a significantly reduced abrasion resistance and increased pilling in comparison to synthetic fibers.

Currently, fabrics for automobile seats are composed predominantly of synthetic fibers and, in that case, mainly of 100% polyester fibers (yarn dyeing/spin-dyed) or a mixture with wool. In fabrics made of 100% polyester, inexpensive filament yarn is predominantly used, with a high-priced worsted yarn being used in a mixture with wool. The high demands of the automotive industry can be met only in this way. The high demands, which are placed on automobile seat fabrics especially by German OEMs, include high abrasion resistance, no occurrence of pilling and fastness to rubbing, especially wet rub fastness. Since the emissions scandal and the growing production of electric vehicles, the criterion of sustainability has become more and more important for the automotive industry. As a result, according to the state of the art, recycled polyester with or without wool is used for the production of automobile seat fabrics. The use of cotton as an ecologically more sustainable fiber is not possible, since it has a fiber diameter that is too small (poor abrasion resistance), a fiber length that is too short (easy pilling) and poor values of wet rub fastness in case of dark colours. This results from the fact that only yarn or, respectively, garment dyeing rather than spin dyeing is possible for cotton. In the past, viscose fibers were also used in combination with polyester fibers. However, the types of fibers used exhibited the same disadvantages as cotton.

It is the object of the present invention to provide a fabric which can be used, in particular, as an automobile seat fabric, in which at least part of the currently used fiber materials made of polyester is replaced by cellulosic fibers.

Said object is achieved by a fabric according to claim 1.

Furthermore, the invention relates to the use of the fabric according to the invention in automotive applications, a process for determining as to whether a fabric or, respectively, the yarns contained therein is (are) suitable for automotive applications, and a process for the production of a fabric which comprises the step of checking as to whether the fabric or, respectively, the yarns contained therein is (are) suitable for automotive applications.

Preferred embodiments are indicated in the subclaims.

DETAILED DESCRIPTION OF THE INVENTION

The fabric according to the invention is composed of twines (warp and weft threads) interwoven in a manner known per se, the twines, in turn, each consisting of two yarns twisted together and containing fibers.

Instead of conventional fabrics as used in automobile seats, the fabrics according to the invention contain at least a certain proportion of yarns which contain cellulosic staple fibers of the type Lyocell (hereinafter referred to as "lyocell fibers") and/or of the types viscose (hereinafter referred to as "viscose fibers") and/or modal (hereinafter referred to as "modal fibers").

The terms "lyocell", "viscose" and "modal" are generic terms which are explained in further detail in the European Textile Labelling Act (https://eur-lex. europa.eu/LexUriServ/LexUriServ.do?uri=OJ:L:2011:272:0001:0064:DE:PDF). Lyocell fibers are cellulose fibers which are obtained by spinning solutions of cellulose without derivatization. Viscose and modal fibers are fibers which are obtained by spinning a cellulose derivative (cellulose xanthogenate) and, in case of modal fibers, are additionally characterized by certain textile parameters.

In the fabrics according to the invention, at least one of the yams twisted together to form a twine contains a mixture of polyester fibers and the cellulosic staple fibers as mentioned.

Preferably, either only lyocell fibers or only modal fibers or, respectively, only viscose fibers are present in the yam as cellulosic staple fibers. However, mixtures are possible as well.

Lyocell fibers or modal fibers or, respectively, mixtures of lyocell fibers and modal fibers are preferably used as cellulosic staple fibers.

Likewise, different yams may be used in a fabric according to the invention, which yams have different compositions, both in terms of the type of cellulosic staple fibers that are contained and their mixing ratio with the polyester staple fibers.

The share of cellulosic staple fibers in the fabric according to the invention is 10% by weight or more, preferably 20% by weight or more, particularly preferably 30% by weight or more.

The upper limit of the share of cellulosic staple fibers in the fabric may reach up to 90% by weight, in particular up to 70% by weight, preferably up to 60% by weight, particularly preferably up to 50% by weight.

With regard to the yarns in which the cellulosic staple fibers are contained, the share of cellulosic staple fibers may range from 10% by weight to 90% by weight, preferably from 20% by weight to 70% by weight, in particular from 30% by weight to 60% by weight.

The weight percentage of cellulosic staple fibers in the yams or, respectively, in the fabric is explained further on the basis of the following examples:

1) A fabric made of two twines, each consisting of two yarns with, in each case, 70% polyester staple fibers and 30% modal fibers:

Overall share of cellulosic staple fibers (herein: modal fibers) in the fabric: 30%.

Share of modal fibers in the yams: 30% each 2) A fabric made of two twines A and B Twine A consists of two yarns with, in each case, 70% polyester staple fibers and 30% modal fibers.

Twine B consists of two yarns with, in each case, 50% polyester staple fibers and 50% lyocell fibers.

Both twines have the same weight.

Overall share of cellulosic staple fibers in the fabric: 40% (average from 30% and 50%)

Share of cellulosic staple fibers in the yarns: 30% or, respectively, 50%.

Surprisingly, it has been found that fabrics are particularly suitable for use in automotive applications, especially in automobile seats, if the fabric or, respectively, those yams contained therein which contain polyester staple fibers and the cellulosic staple fibers as well as the twines produced therefrom comply with the following relationships:

a) $32881*\text{Fiber type}_{cell}+9969*\text{Titer}_{cell}-257*\text{Cut length}_{cell}-20714*\text{Cut length}_{PET}+24514*Z\alpha-20514*G_{\alpha}-4119*\text{Basis weight}+5850*\text{Warp density}+3004*\text{Weft density}-833018\geq 100{,}000$, preferably ≥140,000, particularly preferably ≥170,000, with particular preference ≥195,000 b) $-115*\text{Cut length}_{PET}+171*Z_{\alpha}-129*G_{\alpha}-29*\text{Basis weight}+37*\text{Warp density}+19*\text{Weft density}-\text{yam titer}-6155\geq 1500$, preferably ≥1800, particularly preferably ≥1900.

In this case, the following applies:

Fiber $\text{type}_{cell}$: Fiber type of the cellulosic staple fiber, wherein the following applies: lyocell=1; modal=2, for mixtures of lyocell and viscose and/or modal, the result is a value of between 1 and 2, depending on the weight percentage of the lyocell and viscose or, respectively, modal fibers.

Meaning that, e.g., for mixtures containing lyocell and modal at a ratio of 80 to 20, the value for Fiber $\text{type}_{cell}$=1.2 (1*0.8+2*0.2).

$\text{Titer}_{cell}$Single fiber titer in [dtex] of the cellulose staple fibers contained, for mixtures of lyocell and viscose and/or modal, depending on the weight percentage. Example: In a mixture of lyocell 1.3 dtex and modal 1.7 dtex at a ratio of 80 to 20, the result is a value for $\text{Titer}_{cell}$ of 1.38 (1.3*0.8+1.7*0.2).

Cut $\text{length}_{cell}$ Cut length in [mm] of the cellulose staple fibers contained, for mixtures of lyocell and viscose and/or modal, depending on the weight percentage as in the above example for $\text{Titer}_{cell}$ Cut $\text{length}_{PET}$ Cut length in [mm] of the polyester staple fibers contained $Z_{\alpha}$ twisting factor of the twine:

$$Z_{\alpha} = T \times \sqrt{\frac{Titre}{1000}},$$

wherein

T indicates the twist of the twine in number of twists per metre, and Titer indicates the titer of the twine (in tex)

$G_{\alpha}$ twisting factor of the yarn, to be determined analogously to the twisting factor of the twine

| | |
|---|---|
| Basis weight | Basis weight of the fabric in [g/m$^2$] |
| Warp density | Warp density of the fabric in [Fd/10 cm] |
| Weft density | Weft density of the fabric in [Fd/10 cm] |
| Yarn titer | Titer of the yarns in [dtex] |

A person skilled in the art is familiar with the determination of all the textile parameters indicated above.

It has surprisingly been shown that fabrics complying with the above-indicated formulas achieve the abrasion resistance as demanded by the automotive industry in the so-called "Martindale abrasion cycle test" according to ISO 12947, in particular ISO 12947-2.

In this connection, the automotive industry usually requires an abrasion score of at least 3 with a number of abrasion cycles of 35,000 to 60,000, in particular 50,000 to 60,000, and a support pressure of 12 kPa. The abrasion score is indicated as a measure of the discolouration/graying of the sample according to ISO 105-A02 on a scale from 1 (worst value) to 5 (best value). From a value of 3, the fabric may be considered as suitable for use in automobile seats. In this case, the requirement can vary depending on the positioning of the fabric in the automobile seat (e.g., side panels versus central panel), which is reflected either in a lower requirement with regard to the abrasion score or in a lower number of abrasion cycles.

Furthermore, the automotive industry demands a particular (low) level of damage to the fabric after the end of the abrasion cycle test (i.e., after a number of abrasion cycles of 35,000 to 60,000, in particular 50,000 to 60,000). If two (or more) thread breaks arise at the abraded spot under visual inspection, the fabric is regarded as unsuitable for use in automobile seats.

It has surprisingly become apparent that there is a clear relationship between the combination of the parameters as mentioned and the suitability (or also unsuitability) of a fabric for use especially in automobile seats.

If the fabric according to the invention fulfills the two above formulas a) and b), it also achieves an abrasion score of at least 3 as well as the desired (low) level of damage with a given number of abrasion cycles.

In order to produce the fabric according to the invention, a person skilled in the art merely has to adapt the parameters of the employed yarns, twines and the fabric structure in such a way that the above relationships are complied with.

In a fabric according to the invention, $\text{Titer}_{cell}$ is preferably ≥0.9 dtex, particularly preferably ≥1.25 dtex.

Furthermore, the cut length of the contained cellulosic staple fiber, Cut $\text{length}_{cell}$, is preferably ≥34 mm, particularly preferably ≥38 mm.

For viscose fibers, particularly preferred ranges for $\text{Titer}_{cell}$ are considered to be ≥2.4 dtex, and for Cut $\text{length}_{cell}$, preferably ≥50 mm.

Surprisingly, it has been found that the high demands of the automotive industry can be met by means of a combination of polyester staple fibers with cellulosic staple fibers, especially if the titer of the staple fibers is increased to at least 2.5 dtex and the cut length of the staple fibers is increased to at least 50 mm.

In a further preferred embodiment of the present invention, the twisting factor $Z_{\alpha}$of twines containing yarns with cellulosic staple fibers amounts to 140-165.

Furthermore, the twisting factor $G_{\alpha}$ of yarns containing cellulosic staple fibers preferably amounts to 90-135, in particular to 110-135.

The basis weight of the fabric according to the invention may preferably be 180-500 [g/m$^2$].

A person skilled in the art is able to adjust the warp and weft density as a function of the thickness of the employed yarns within the scope of his or her technical knowledge.

A fabric is particularly preferred which exhibits a combination of all the above-described preferred values, to which, hence, the following applies:

$\text{Titer}_{cell}$ preferably ≥0.9 dtex, particularly preferably ≥1.25 dtex, in particular ≥2.4 dtex or ≥2.5 dtex.

Cut $\text{length}_{cell}$ preferably ≥34 mm, particularly preferably ≥38 mm, in particular at least 50 mm Twisting factor of the twine $Z_{\alpha}$ 140-165

Twisting factor of the yarn $G_{\alpha}$ 90-135, in particular 110-135

Basis weight: 80-500 [g/m$^2$].

The cellulosic staple fibers contained in a fabric according to the invention can be dyed, in particular spin-dyed. Spin dyeing is understood by the person skilled in the art as the admixture of a dye into the spinning dope from which the fiber is spun, or into a precursor thereof. As a result, fibers are created which are dyed not only on the surface, but also continuously across their fiber matrix.

If such spin-dyed man-made cellulose fibers are used within the specifications of the above formulas a) and b), the required specification of wet rub fastness, which is particularly critical for such fibers, can be achieved even in fibers with dark colours.

Another preferred embodiment of the fabric according to the invention is characterized in that part of the twines contain a polyester filament yarn or consist of polyester filament yarns.

Surprisingly, it has been found that a (partial) use of polyester filament yarns, as they are actually already now used for the production of fabrics for automobile seats, has no influence on the correlations as indicated by the above formulas a) and b).

In other words, a certain share of polyester filament yarns makes no difference for the suitability of the fabrics according to the invention in automobile seats.

A further preferred embodiment of the fabric according to the invention is characterized in that the fabric contains no other textile fiber materials apart from polyester staple fibers, lyocell staple fibers, viscose staple fibers and/or modal staple fibers and, optionally, polyester filament yarns.

Another aspect of the present invention relates to the use of a fabric according to the invention in automotive applications, in particular as a fabric cover in automobile seats.

The present invention also relates to a process for determining the suitability of a fabric made of interwoven twines, wherein, in each case, two yarns are twisted together to form a twine and at least one of the yarns contains polyester staple fibers and cellulosic staple fibers of the types lyocell, viscose and/or modal, the share of cellulosic staple fibers in the fabric ranging from 10% by weight to 90% by weight, for use in automobiles, in particular in automobile seats, which is characterized in that, for the fabric or, respectively, those of the yarns contained therein which contain polyester staple fibers and cellulosic staple fibers, as well as the twines produced therefrom, the values resulting from the two expressions a') $32881*\text{Fiber type}_{cell}+9969*\text{Titer}_{cell}-257*\text{Cut length}_{cell}-20714*\text{Cut length}_{PET}+24514*Z_{\alpha}-20514*G_{\alpha}-4119*\text{Basis weight}+5850*\text{Warp density}+3004*\text{Weft density}-833018$ and b') $-115*\text{Cut length}_{PET}+171*Z_{\alpha}-129*G_{\alpha}-29*\text{Basis weight}+37*\text{Warp density}+19*\text{Weft density}-\text{yarn titer}-6155$ are determined and it is checked as to whether the value resulting from the expression a' is ≥100,000, preferably ≥140,000, particularly preferably ≥170,000, with particular preference ≥195,000, and the value resulting from the expression b' is ≥1500, preferably ≥1800, particularly preferably ≥1900.

The parameters used in the two expressions a' and b' and their measurement are as already indicated above.

If both values resulting from the expressions a' and b' are above the above-indicated lower limits, the fabric is suitable for use in automobiles, in particular in automobile seats.

The lower limits can be chosen by a person skilled in the art depending on the specifications given by the customer (automobile manufacturer). If, for example, the customer considers a slightly lower abrasion score (of, e.g., 3) or, respectively, the achievement of a particular abrasion score with a lower number of abrasion cycles (of, e.g., 35,000) to be sufficient for a certain application, the lower limit of the value for the expression a' can be set in the lower range (starting with 100,000).

Furthermore, the present invention relates to a process for the production of a fabric made of interwoven twines, wherein, in each case, two yarns are twisted together to form a twine and at least one of the yarns contains polyester staple fibers and cellulosic staple fibers of the types lyocell, viscose and/or modal, the fabric being intended for use in automobiles, in particular in automobile seats, the share of cellulosic staple fibers in the fabric ranging from 10% by weight to 90% by weight, comprising the step of inserting existing or planned parameters of the fabric or, respectively, of the yarns contained therein which contain polyester staple fibers and cellulosic staple fibers, and of the twines produced therefrom, in the expressions a') $32881*\text{Fiber type}_{cell}+9969*\text{Titer}_{cell}-257*\text{Cut length}_{cell}-20714*\text{Cut length}_{PET}+24514*Z_{\alpha}-20514*G_{\alpha}-4119*\text{Basis weight}+5850*\text{Warp density}+3004*\text{Weft density}-833018$ and b') $-115*\text{Cut length}_{PET}+171*Z_{\alpha}-129*G_{\alpha}-29*\text{Basis weight}+37*\text{Warp density}+19*\text{Weft density}-\text{yarn titer}-6155$ optionally, adapting the existing parameters or, respectively, completing the parameters, so that the value resulting from the expression a' is ≥100,000, preferably ≥140,000, particularly preferably ≥170,000, with particular preference ≥195,000, and the value resulting from the expression b' is ≥1500, preferably ≥1800, particularly preferably ≥1900.

The parameters used in the two expressions a' and b' and their measurement are again as already defined above.

A person skilled in the art is thus able to determine in the course of the production of a fabric on the basis of the parameters of the yarns, twines and the fabric, which are envisaged, as to whether a suitable fabric will be producible therewith. If this is not the case since the desired values (right-hand side of the formula) are not complied with, the person skilled in the art can modify one or more parameters accordingly.

EXEMPLARY EMBODIMENTS:

Yarns were produced from polyester staple fibers and lyocell staple fibers as well as spin-dyed modal staple fibers. In each case, two of those yarns were twisted into a twine, and the resulting twines were interwoven to form a fabric.

In the yarns, the (weight) ratio of cellulosic staple fibers to polyester staple fibers was, in each case, 30 to 70.

The resulting fabrics were subjected to a Martindale abrasion cycle test. The number of abrasion cycles was 50,000 revolutions in each case, with the exception of those fabrics, the cellulose fibers, which had a cut length of 75 mm. In those fabrics, the number of abrasion cycles was 60,000 revolutions.

In the following tables, the respective parameters of the employed fiber materials, the yarns, the twines and the fabric are summarized.

In this regard, Table 1 lists the parameters relevant for formula a), the value resulting when inserted into the left part of formula a), and the abrasion score actually obtained.

Table 2 lists the parameters relevant for formula b), the value resulting when inserted into the left part of formula b), and the result of the actual assessment of the level of damage ("0" for "no damage", i.e., less than 2 thread breaks at the abraded spot, "1" for "damage", i.e. , 2 or more thread breaks at the abraded spot):

TABLE 1

| Example No. | Fibre $type_{cell}$* | $Titer_{cell}$ (dtex) | Cut $length_{cell}$ (mm) | Cut $length_{PET}$ (mm) | $Z_\alpha$ | $G_\alpha$ | Basis weight ($g/m^2$) | Warp density (Fd/10 cm) | Weft density (Fd/10 cm) | Result formula | Abrasion score measured |
|---|---|---|---|---|---|---|---|---|---|---|---|
| 1 | 1 | 1.4 | 38 | 38 | 133 | 110 | 304 | 275 | 124 | 149814 | 3 |
| 2 | 1 | 2.8 | 50 | 50 | 154 | 120 | 299 | 272 | 124 | 224817 | 4.5 |
| 3 | 1 | 3.3 | 60 | 60 | 165 | 125 | 302 | 272 | 124 | 174819 | 3.5 |
| 4 | 2 | 3.3 | 51 | 60 | 160 | 135 | 328 | 316 | 188 | 224865 | 4.5 |
| 5 | 2 | 3.3 | 51 | 60 | 160 | 135 | 232 | 272 | 124 | 149919 | 3 |
| 6 | 1 | 2.8 | 50 | 60 | 165 | 125 | 300 | 248 | 168 | 172418 | 3.5 |
| 7 | 1 | 3.3 | 60 | 60 | 165 | 125 | 300 | 248 | 168 | 174833 | 3.5 |
| 8 | 2 | 2.5 | 50 | 60 | 165 | 125 | 300 | 248 | 168 | 202306 | 4 |
| 9 | 1 | 4.7 | 75 | 78.4 | 151 | 90 | 300 | 248 | 168 | 178591 | 3.5 |
| 10 | 1 | 6.7 | 75 | 78.4 | 151 | 90 | 300 | 248 | 168 | 198529 | 4 |
| 11 | 2 | 3.3 | 75 | 78.4 | 151 | 90 | 300 | 248 | 168 | 197515 | 4 |

*1 = lyocell, 2 = modal

TABLE 2

| Example No. | Fibre $type_{cell}$* | $Titer_{cell}$ (dtex) | Cut $length_{cell}$ (mm) | Cut $length_{PET}$ (mm) | $Z_\alpha$ | $G_\alpha$ | Basis weight ($g/m^2$) | Warp density (Fd/10 cm) | Weft density (Fd/10 cm) | Yarn titer (dtex) | Result formula | Damage |
|---|---|---|---|---|---|---|---|---|---|---|---|---|
| 1 | 1 | 1.4 | 38 | 38 | 133 | 110 | 304 | 275 | 124 | 769.23 | 1974 | 1 |
| 2 | 1 | 2.8 | 50 | 50 | 154 | 120 | 299 | 272 | 124 | 714.29 | 1984 | 0 |
| 3 | 1 | 3.3 | 60 | 60 | 165 | 125 | 302 | 272 | 124 | 714.29 | 1983 | 0 |
| 4 | 2 | 3.3 | 51 | 60 | 160 | 135 | 328 | 316 | 188 | 588.24 | 2054 | 0 |
| 5 | 2 | 3.3 | 51 | 60 | 160 | 135 | 232 | 272 | 124 | 588.24 | 1994 | 0 |
| 6 | 1 | 2.8 | 50 | 60 | 165 | 125 | 300 | 248 | 168 | 714.29 | 1989 | 0 |
| 7 | 1 | 3.3 | 60 | 60 | 165 | 125 | 300 | 248 | 168 | 714.29 | 1989 | 0 |
| 8 | 2 | 2.5 | 50 | 60 | 165 | 125 | 300 | 248 | 168 | 714.29 | 1989 | 0 |
| 9 | 1 | 4.7 | 75 | 78.4 | 151 | 90 | 300 | 248 | 168 | 714.29 | 1994 | 0 |
| 10 | 1 | 6.7 | 75 | 78.4 | 151 | 90 | 300 | 248 | 168 | 714.29 | 1994 | 0 |
| 11 | 2 | 3.3 | 75 | 78.4 | 151 | 90 | 300 | 248 | 168 | 714.29 | 1994 | 0 |

*1 = lyocell, 2 = modal

The tables impressively show the correlation between the suitability or, respectively, also unsuitability of the respective fabric and the values obtained from formulas a) and b).

In this regard, Example 1 indeed meets the requirements with regard to the abrasion score in the abrasion cycle test (the condition of formula a) is met, see table 1), but fails to meet the condition of formula b) (see table 2) and therefore displayed too high a level of damage.

What is claimed is:

1. A fabric made of interwoven twines comprising at least two twines wherein each twine comprises two yarns twisted together, and at least one of the yarns comprises polyester staple fibres and cellulosic staple fibres wherein the cellulosic staple fibres are selected from lyocell, viscose, modal, and combinations thereof, wherein a share of the cellulosic staple fibres in the fabric ranges from 10% by weight to 90% by weight, and wherein at least one of the fabric, the yarns and the twines comply with the following relationships:

a) $32881*\text{Fiber type}_{cell}+9969*\text{Titer}_{cell}-257*\text{Cut length}_{cell}-20714*\text{Cut length}_{PET}+24514*Z_\alpha-20514*G_\alpha-4119*\text{Basis weight}+5850*\text{Warp density}+3004*\text{Weft density}-833018\geq 100{,}000$; and b) $-115*\text{Cut length}_{PET}+171*Z_\alpha-129*G_\alpha-29*\text{Basis weight}+37*\text{Warp density}+19*\text{Weft density}-\text{yarn titer}-6155\geq 1500$.

2. The fabric according to claim 1, wherein the $\text{Titre}_{cell}$ is >0.9 dtex.

3. The fabric according to claim 1, wherein the Cut $\text{length}_{cell}$ is >34 mm.

4. The fabric according to claim 1, wherein the $Z_\alpha$ is 140-165.

5. The fabric according to claim 1, wherein the $G_\alpha$ is 90-135.

6. The fabric according to claim 1, wherein the basis weight is 180-500 [$g/m^2$].

7. The fabric according to claim 1, wherein the share of cellulosic staple fibres in the fabric is 20% by weight or more.

8. The fabric according to claim 7, wherein the share of cellulosic staple fibres in the fabric is up to 70% by weight.

9. The fabric according to claim 1, wherein the share of cellulosic staple fibres in the yarns which cellulosic staple fibres are contained ranges from 10% by weight to 90% by weight.

10. The fabric according to claim 1, wherein the cellulosic staple fibres are spin-dyed.

11. The fabric according to claim 1, wherein at least one twine comprises a polyester filament yarn.

12. The fabric according to claim 1, wherein the fabric comprises textile fibers materials which consist essentially of mixtures of the polyester staple fibres and the cellulosic staple fibres.

13. The fabric according to claim 1 for use as a fabric cover in automobile seats.

14. A process for the production of a fabric made of interwoven twines, comprising:

twisting together at least two twines, wherein each twine comprises two yarns twisted together, wherein at least one of the yarns comprises polyester staple fibres and cellulosic staple fibres wherein the cellulosic staple fibres are selected from lyocell, viscose, modal, and combinations thereof, and wherein the share of cellulosic staple fibres in the fabric ranges from 10% by weight to 90% by weight wherein at least one of the fabric, the yarns and the twines satisfy the following expressions:

a') $32881*\text{Fiber type}_{cell}+9969*\text{Titer}_{cell}-257*\text{Cut length}_{cell}-20714*\text{Cut length}_{PET}+24514*Z_{\alpha}-20514*G_{\alpha}-4119*\text{Basis weight}+5850*\text{Warp density}+3004*\text{Weft density}-833018>100{,}000$; and b') $-115*\text{Cut length}_{PET}+171*Z_{\alpha}-129*G_{\alpha}-29*\text{Basis weight}+37*\text{Warp density}+19*\text{Weft density}-\text{yarn titer}-6155>1500$.

15. The fabric according to claim 1, wherein the value from the expression a is ≥140,000.

16. The fabric according to claim 1, wherein the value from the expression a is ≥170,000.

17. The fabric according to claim 1, wherein the value from the expression a is ≥195,000.

18. The fabric according to claim 1, wherein the value from the expression b is ≥1800.

19. The fabric according to claim 1, wherein the value from the expression b is ≥1900.

20. The fabric according to claim 2, wherein the $\text{Titre}_{cell}$ is >1.25 dtex.

21. The fabric according to claim 3, wherein the $\text{Cut length}_{cell}$ is >38 mm.

22. The fabric according to claim 5, wherein the $G_{\alpha}$ is 110-135.

23. The fabric according to claim 7, wherein the share of cellulosic staple fibres in the fabric is 30% by weight or more.

24. The fabric according to claim 8, wherein the share of cellulosic staple fibres in the fabric is up to 60% by weight.

25. The fabric according to claim 8, wherein the share of cellulosic staple fibres in the fabric is up to 50% by weight.

26. The fabric according to claim 9, wherein the share of cellulosic staple fibres in the yarns which cellulosic staple fibres are contained ranges from 20% by weight to 70% by weight.

27. The fabric according to claim 9, wherein the share of cellulosic staple fibres in the yarns which cellulosic staple fibres are contained ranges from 30% by weight to 60% by weight.

28. The fabric according to claim 1, wherein the fabric comprises textile fibers materials which consists essentially of mixtures of the polyester staple fibres, polyester filament yarns and the cellulosic staple fibres.

29. The process according to claim 14, wherein determining the value resulting from the expression a' is ≥140,000.

30. The process according to claim 14, wherein determining the value resulting from the expression a' is ≥170,000.

31. The process according to claim 14, wherein determining the value resulting from the expression a' is ≥195,000.

32. The process according to claim 14, wherein determining the value resulting from the expression b' is ≥1800.

33. The process according to claim 14, wherein determining the value resulting from the expression b' is ≥1900.

* * * * *